United States Patent [19]

Skoe

[11] Patent Number: 4,479,755

[45] Date of Patent: Oct. 30, 1984

[54] COMPRESSOR BOUNDARY LAYER BLEEDING SYSTEM

[75] Inventor: Ivar H. Skoe, Kongsberg, Norway

[73] Assignee: A/S Kongsberg Vapenfabrikk, Kongsberg, Norway

[21] Appl. No.: 370,919

[22] Filed: Apr. 22, 1982

[51] Int. Cl.[3] ..... F04D 17/10; F04D 29/68

[52] U.S. Cl. ..... 415/1; 415/DIG. 1; 415/119; 415/144

[58] Field of Search ..... 415/DIG. 1, 206, 119, 415/213 R, 144, 28

[56] References Cited

U.S. PATENT DOCUMENTS

| | | | |
|---|---|---|---|
| 3,226,940 | 1/1966 | Jekat et al. | 416/206 X |
| 3,824,029 | 7/1974 | Fabri et al. | 415/206 X |
| 3,887,295 | 6/1975 | Yu | 415/213 R X |
| 3,893,787 | 7/1975 | Jones | 415/DIG. 1 X |
| 4,063,848 | 12/1977 | Wiggins et al. | 415/206 |
| 4,086,022 | 4/1978 | Freeman et al. | 415/DIG. 1 X |
| 4,212,585 | 7/1980 | Swarden et al. | 415/206 X |
| 4,228,753 | 10/1980 | Davis et al. | 415/DIG. 1 X |
| 4,248,566 | 2/1981 | Chapman et al. | 415/DIG. 1 X |

*Primary Examiner*—Everette A. Powell, Jr.
*Attorney, Agent, or Firm*—Finnegan, Henderson, Farabow, Garrett & Dunner

[57] ABSTRACT

Acoustically sized bleed passages are provided in the shroud wall of a rotary compressor to admit expansion waves to the suction-sides of successive passing blades to control the boundary layer. The expansion waves are generated by reflecting compression waves formed in the passages by the pressure sides of passing blades. The passages are oriented to receive high pressure bleed gas at maximum gas particle velocity, and the passages are configured to diffuse the gas to increase static bleed pressure.

18 Claims, 5 Drawing Figures

COMPRESSOR BOUNDARY LAYER BLEEDING SYSTEM

BACKGROUND OF THE INVENTION

1. Field of the Invention

This invention relates to improvements in a method and apparatus for bleeding off the fluid boundary layer in rotating compressor apparatus.

2. Description of the Prior Art

For advanced axial compressor rotors and centrifugal compressor inducers, shock-boundary layer interaction in the entry region can cause unacceptable boundary layer growth. High boundary layer blockage levels are generally associated with reduced performance for these turbomachines, and it has long been recognized that rotor performance gains would result if boundary layer bleed could be used. For example, U.S. Pat. No. 2,720,356 to Erwin discloses a system for continuous boundary layer control in axial compressors associated with aircraft gas turbine engines, and U.S. Pat. No. 4,248,566 to Chapman et al. describes a boundary layer bleed system for a centrifugal compressor.

In several reports on centrifugal compressors, the rotor flow is reported to separate in the suction side/-shroud corner of the flow path where it turns radial. The static pressure at the critical location in the compressor housing (suction side/shroud corner) is generally low compared to compressor inlet pressure. Further, the blade-to-blade static pressure difference is such that conventional boundary layer extraction slots would bleed off most of the flow from the (not critical) pressure side of the blade. Frequently, therefore, the total amount of bleed fluid extracted to achieve boundary layer control on the suction sides is excessive and-/or the work required to extract (or bleed) boundary layer fluid does not produce the desired theoretical increased overall efficiency.

The present invention is related to improving the suction side boundary layer bleed characteristics as applied in turbomachines of different kinds to achieve increased efficiencies. In gas turbine engines where bleed flow is required outside the compressor component, cycle benefits may result if these fluid bleed flows are used, for example to achieve cooling, in addition to the improved compressor performance. Application of the present invention will enhance the performance gains associated with such applications.

SUMMARY OF THE INVENTION

In accordance with the purpose of the invention, as embodied and broadly described herein, the improved apparatus for controlling the fluid boundary layer in a compressor having a plurality of blades rotating in a housing, the apparatus having at least one bleed passage through the housing wall connected to a fluid collector for continuously extracting fluid from the region of the housing wall, the bleed passage having an inlet and an outlet, wherein the improvement comprises means for periodically lowering the static pressure at the bleed passage inlet to coincide with the arrival of the suction sides of successive blades, and for increasing the amount of fluid extracted from the suction sides for a given collector static pressure.

Preferably, the pressure lowering means includes means for periodically generating expansion waves in the bleed passage, the expansion waves travelling in the direction opposite that of the flow of fluid being extracted, and means for admitting in succession each of the expansion waves to the region through the bleed passage inlet after a blade has passed the passage inlet.

It is further preferred that the generating means includes the bleed passage inlet being located in the portion of the housing wall adjacent the rotating blades for receiving successive compression waves formed by the fluid extracted from the pressure sides of the rotating blades and travelling in the bleed passage toward the collector, and that the bleed passage outlet is configured to reflect the successive compression waves as expansion waves travelling back towards the compressor blades, wherein the admitting means includes the length of the bleed passage being acoustically sized to provide the desired coincidence between the periodic arrival of the suction sides of the compressor blades and the periodic arrival at the bleed passage inlet of the expansion waves.

And it is still further preferred that the bleed passage inlet axis is inclined to a radius drawn to the axis of rotation of the compressor blades both in the direction of rotation and in the direction of the rotational axis for receiving the bleed fluid at high velocity, and wherein the cross-sectional flow area of the bleed passage may increase in the bleed fluid flow direction for diffusing the bleed fluid flowing therein, for maximizing the bleed passage static pressure relative to the available compressor housing region stagnation pressure.

Further in accordance with the invention as embodied and broadly described herein, in the improved method for controlling the fluid boundary layer in a compressor having a plurality of blades rotating in a housing, the method including the step of continuously extracting fluid from the region of the housing wall through at least one bleed passage formed in the housing wall to a fluid collector, the bleed passage having an inlet and an outlet, the improvement in the extracting step comprises the step of periodically lowering the static pressure at the bleed passage inlet to coincide with the arrival of the suction sides of the compressor blades, for increasing the amount of fluid extracted from the suction sides for a given collector static pressure.

Preferably, the pressure-lowering step includes the substeps of periodically forming expansion waves in the bleed passage, the expansion waves travelling in the direction opposite the flow of fluid being extracted; and admitting in succession each of said expansion waves to said region immediately after a blade has passed the bleed passage inlet; wherein the substep of forming an expansion wave includes the additional substeps of periodically forming compression waves in the bleed passage with the fluid extracted from the pressure sides of successive blades, and reflecting the compression waves at the bleed passage outlet to produce the periodic expansion waves.

It is also preferred that the period of said expansion waves is equal to, or a multiple of, the time between the passage of successive blades past the bleed passage inlet.

And it is further preferred that the extracting step further includes the step of receiving the extracted fluid into the bleed passage at maximum fluid particle velocity and the step of diffusing the fluid in the bleed passage to maximize the bleed passage pressure relative to the available compressor housing region stagnation pressure.

The accompanying drawing which is incorporated in, and constitutes a part of, this application illustrates one embodiment of the invention and, together with the description, serves to explain the principles of the invention.

DESCRIPTION OF THE PREFERRED EMBODIMENT

Figure 1:
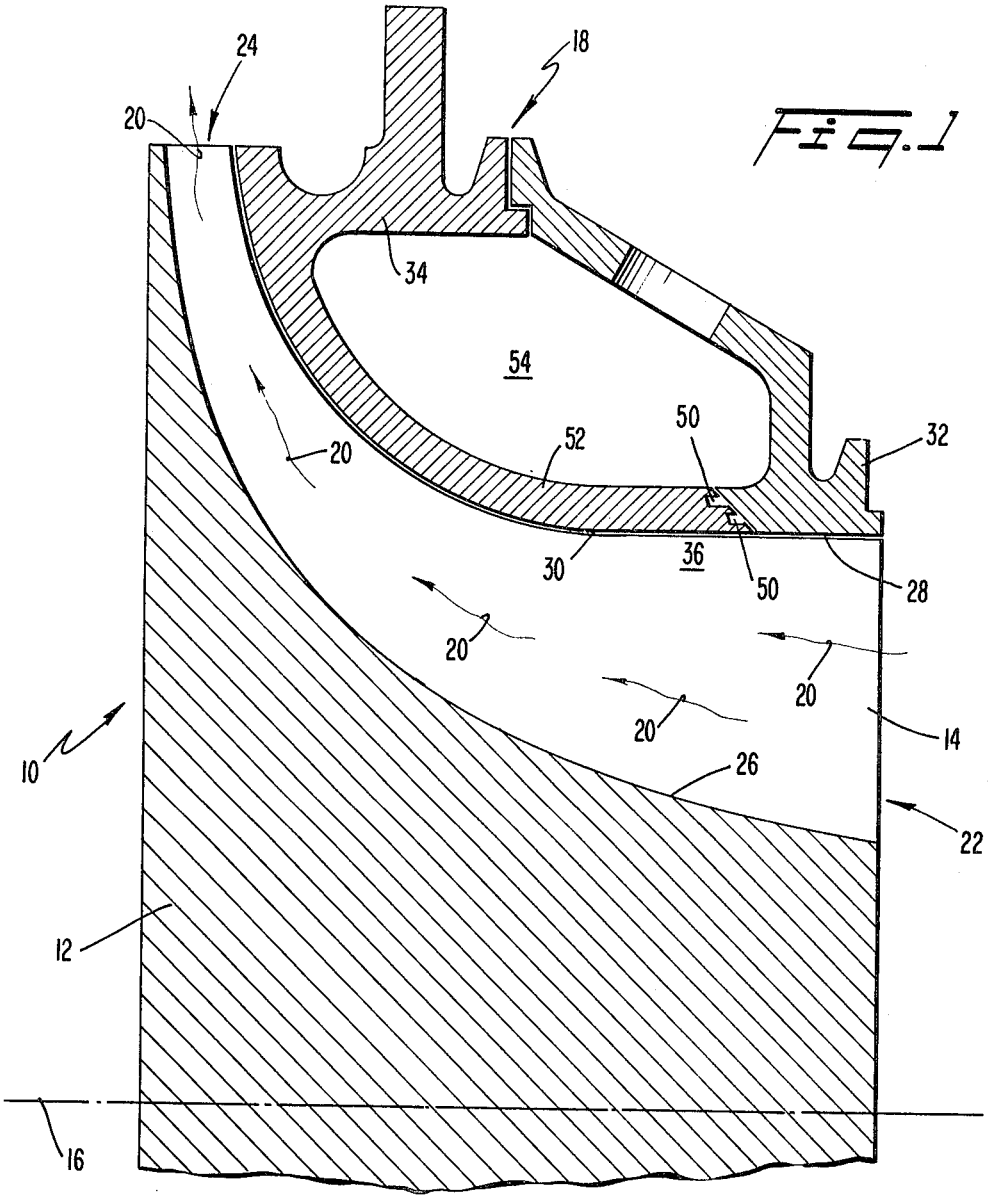
FIG. 1 is a schematic cross-sectional representation of a rotary compressor apparatus made in accordance with the present invention, taken in the plane of the axis of rotation.

With reference to FIG. 1, there is shown a rotary compressor made in accordance with the present invention and designated generally as 10. Compressor 10 is of the centrifugal type having a hub 12 with a plurality of blades such as blades 14 mounted on hub 12. Hub 12 and blades 14 rotate about an axis 16 inside a housing designated generally as 18 which, together with the hub 12 defines the fluid flow path 20 (designated by arrows) through the compressor 10. For the centrifugal compressor 10 shown in the figures, bulk fluid at low pressure enters at entrance 22 and leaves at exit 24 at high pressure. The exact path for fluid particles through the compressor 10 is a complex spiral due to the effect of rotating blades 14. Although a centrifugal compressor is shown, the present invention can be used with pure axial compressors and mixed axial-radial compressors, and the present embodiment is not to be taken as a limitation of the present invention.

As is well known, during operation of compressors such as centrifugal compressor 10, fluid boundary layers are built up, not only on the rotating surface 26 of hub 12, but also on the stationary surfaces 28, 30 of shroud parts 32, 34 of housing 18. It is also well known that the potential adverse effects of boundary layers in terms of separation-induced turbulence and consequent degradation of compressor performance is most pronounced in the vicinity of surfaces 28, 30 (designated region 36 in the figures). The prior art has attempted to deal with the boundary layer formation problems by bleeding off the boundary layer from region 36. Typically, the prior art utilize bleed passages through the housing wall communicating with a fluid collector that is maintained at a static pressure sufficiently low compared to the static pressure of the compressor region so that boundary layer extraction is accomplished. Although bleeding fluid from the compressor reduces the fluid mass through-put, if the amount of bleed fluid can be kept small, an overall increase in the efficiency of the compressor may be achieved.

It can be further appreciated that, because of the proximity of the tips of rotating blades 14 to surfaces 28 and 30, that the boundary layer is not homogenous in the tangential direction at a given axial location. In particular, and with reference to FIG. 3 which is an axial view of the compressor 10, the static pressure in region 36 can be significantly lower in the region 38 immediately behind rotating blade 14 (i.e. the "suction side" of blade 14) compared to that in region 40 ahead of rotating blade 14 (i.e. the "pressure side" of blade 14). Lower static pressures in the regions 38 makes it difficult to bleed of the boundary layer from the suction sides of the blades without extracting an overly great amount of fluid from the pressure side and degrading the volumetric capacity of the compressor, if the present invention is not utilized. It is especially important and consequently the purpose of the present invention to provide means for improving the bleeding of the boundary layer from the suction sides of the blades.

In accordance with the present invention, and as embodied herein in the compressor 10 as shown in the figures, a plurality of bleed passages such as passages 50 are formed through wall 52 of housing 18 and communicate with a fluid collector region such as collector 54, which is formed as part of housing 18 in the present embodiment. Each of the bleed passages 50 includes an inlet portion designated 56 which is in communication with the compressor region 36 from which the boundary layer is to be extracted, and also an outlet portion 58 communicating with the collector 54. Fluid extracted from the boundary layer in compressor region 3 travels through the passages 50 including inlets 56 and outlets 58, to collector 54 where it can be discarded, utilized elsewhere in the system or reintroduced into another region of the compressor. Although collector 54 is shown as part of housing 18, other configurations are possible such as a separate annular collector duct (not shown) and are considered within the scope of the present invention.

Further in accordance with the present invention, means are provided for periodically lowering the static pressure at the bleed passage inlets to coincide with the arrival of the suction sides of the compressor blades. As embodied herein, the static pressure lowering means includes means for periodically generating expansion waves in passages 50 running countercurrent to the direction of flow of the extracted boundary layer fluid and admitting the expansion waves into region 36 through the bleed passage inlets 56 coincidentally with the arrival of the suction sides of blades 14. The arrival of expansion waves at the passage inlets 56 results in a periodic decrease in the passage inlet static pressure relative to the time average pressure, for a given collector 54 static pressure. As the periodic decreases in passage inlet static pressure are timed to coincide with the arrival of the blade suction sides as will be explained hereinafter, preferential increases in the boundary layer fluid extracted from the suction sides can be achieved while maintaining the overall increase in the amount of extracted boundary layer fluid to a minimum.

As further embodied herein, bleed passages 50 are located in housing wall 52 such that the passage inlets 56 are adjacent the tips of rotating blades 14. Additionally, bleed passages 50 are configured and oriented to allow compression waves to be generated periodically in the bleed passage inlet 56 by the relatively high pressure fluid extracted from the pressure sides of the rotating blades 14. These periodic compression waves travel toward the collector 54 and then are reflected at the bleed passage outlets 58 to form the desired periodic expansion waves travelling in the opposite direction. Coincidence between the arrival of the reflected expansion waves and the suction sides of the next or succeeding blades 14 at the passage inlet is provided by appropriately sizing the length of the individual bleed passages.

In particular, the length of bleed passages 50 is determined by acoustical wave considerations together with a designed operating condition of the compressor, including type and temperature of fluid, and number and speed of rotation of the compressor blades. In general, the sound propagation velocity (a) in the bleed passages 50 can be determined by the following expression:

$$(a) = \sqrt{\gamma R T_s}$$

where $\gamma = (Cp/Cv)$, the specific heat ratio for the fluid, R is the gas constant, and Ts is an average static temperature in the bleed passage 50. The average bleed passage temperatures will be determined by the actual proportions of high pressure "hot" fluid and low pressure "cool" fluid which originate from the high and low pressure sides of the blades 14. Additionally, the cross-sectional area distribution of the bleed passages 50 and the presence of heat transfer effects will modify the temperature in the bleed channel to some degree, but one skilled in the art can make the necessary computations and adjustments for a particular design of compressor 10.

The acoustic length $L_a$ of the bleed passage 50 to achieve coincidence for a particular configuration of compressor 10, including $Z_r$, the number of blades 14 around the circumference of hub 12; $Z_b$, the number of bleed passages 50 around the circumference of housing 18; and N, the compressor speed (RPM) is determined by the following expression:

$$L_a = (a) \cdot \frac{30}{Z_r N} \cdot \frac{Z_b + Z_r}{Z_b}$$

When the acoustic length $L_a$ of the channel is sized after the above formula, the compression wave which was generated at the bleed passage inlet 56 by the pressure side of one of blades 14 is reflected as an expansion wave at the bleed passage outlet 58 and arrives back at the bleed passage inlet 56 at the time when the suction side of the next one of blades 14 passes the bleed passage inlet 56 in question. Moreover, if the acoustic length $L_a$ is increased in multiples M of:

$$M = (a) \cdot \frac{30}{N Z_r}$$

the same "acoustic tuning" will persist, as the reflected expansion waves will arrive at the time the suction sides of the second (or third, etc.) succeeding ones of blades 14 pass the particular bleed passage inlet 56. Lengthening bleed passages 50 in this manner has the effect of increasing the period of successive expansion waves in a given bleed passage 50 to multiples of the time between the passage of successive blades 14 past the respective bleed passage inlet.

The sizing of the bleed passages 50 cross-sectional area depends on the desired fluid bleed mass flow rate, the stagnation pressure level in region 36 at the point of extraction, and the static pressure in collector 54. For low pressure boundary layer extraction (e.g. inducer entry for centrifugal compressors, first stage of axial compressor rotors, etc.) the static pressure at the suction point of extraction is generally below atmospheric pressure. Under such circumstances, and in accordance with the present invention, the bleed passage 50 is configured to recover part of the dynamic pressure in order to maximize the static pressure in bleed passage 50 relative to the available stagnation pressure in compressor housing region 36. This pressure recovery can provide a net pressure driving force between the bleed passage 50 and collector 54, in cases where the compressor static pressure is low compared to collector 54 static pressure or permit a higher static pressure to be used in collector 54 to maintain the same bleed fluid flow rate through bleed passages 50, thus reducing the power needed to evacuate collector 54.

Figure 4:
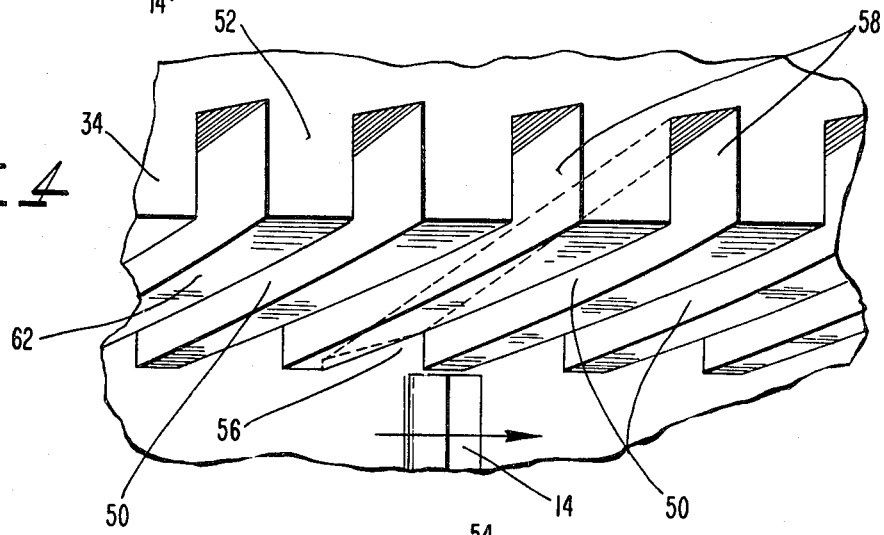
FIG. 4 is a cross-sectional view of the apparatus detail depicted in FIG. 2 taken at the line 4—4.

As embodied herein, and as best seen in FIG. 4, each of the individual bleed passages 50 is configured to function as a subsonic diffuser, that is, with a gradually but continuously increasing cross-sectional flow area. As shown in FIG. 4 wherein the individual bleed passages 50 are shown to be rectangular in shape, the cross section at the inlet 56 (see hatched lines) is less than that at outlet 58. The increasing flow area results in an increase in the static pressure of the fluid relative to the available stagnation pressure at the point of extraction in region 36 due to the conversion of the kinetic energy of the high velocity fluid being bled. Other cross-sectional shapes for passages 50 could, of course, be used and are considered within the scope of the present invention.

The high velocity of the fluid in the inlet portion 56 of the bleed channel 50 is a consequence of the design and orientation of the inlet portion 56, as will be discussed hereinafter. Because the flow rate of the bleed fluid in collector 54 depends on the static pressure difference between the bleed passage 50 and collector 54, positive bleed can be achieved even in conditions where the compressor housing region 36 static pressures are below the collector 54 static pressure. For high pressure bleed systems (for example, bleed air as used in compressors for gas turbine engines) a diffusing bleed passage system enables the bleed location to be located further upstream (i.e., nearer the compressor entrance 22—FIG. 1) in lower static pressure regions 36 while maintaining the desired bleed mass flow rate. Additional advantages of using diffusing bleed passages 50 made in accordance with the present invention include a reduction in the bleed fluid temperature as the point of extraction is moved further upstream and/or reduction in the power consumption necessary to maintain collector 54 at a static pressure sufficient to effect the desired boundary layer bleed. As a result of the present invention, the location of bleed passage 50 can thus be optimized with respect to overall engine performance.

Figure 2:
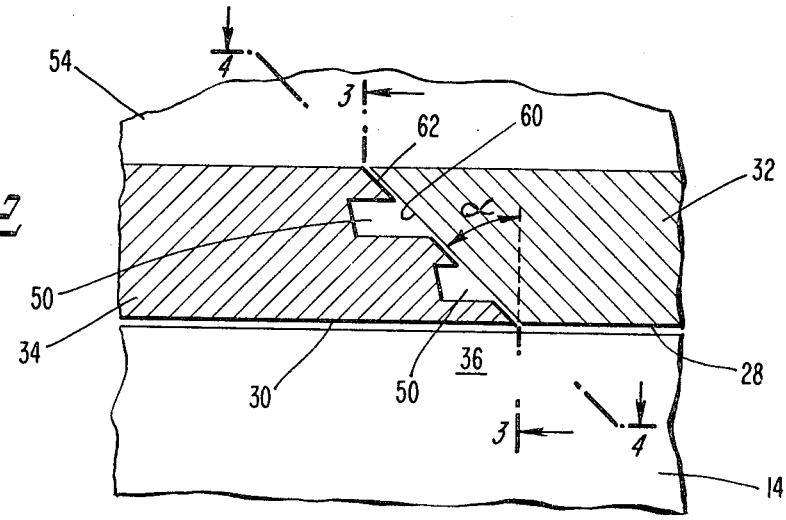
FIG. 2 is a detail of a portion of the apparatus depicted in FIG. 1.
Figure 3:
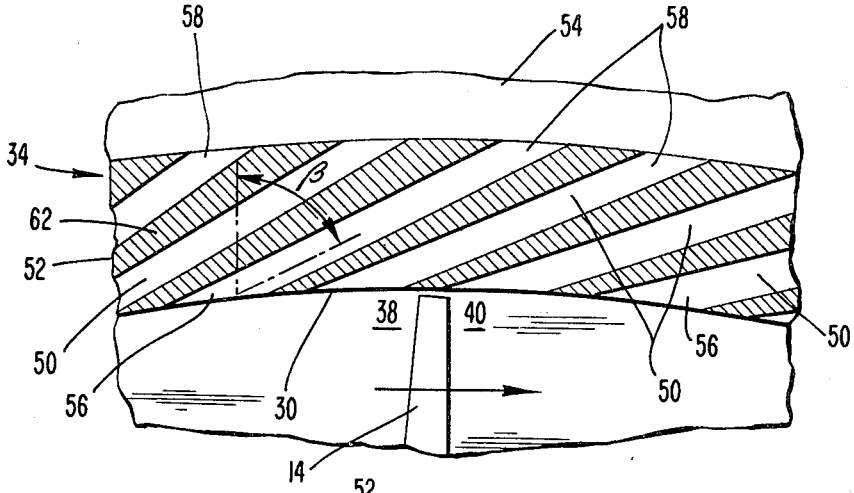
FIG. 3 is a cross-sectional view of the apparatus detail depicted in FIG. 2 taken at the line 3—3.

As further embodied herein, the bleed passage inlet 56 is oriented at angles to a radius drawn through the point of extraction, that is, where bleed passage inlet 56 intersects surface 30, in both the axial direction and in the tangential direction. As best seen in FIG. 2, the axis of the bleed passage inlet 56 forms an angle $\alpha$ with a radius in the axial direction, and as seen in FIG. 3, the bleed passage inlet 56 forms an angle $\beta$ with a radius in the tangential direction. This orientation is a consequence of the fact that the fluid particles in compressor 10 have both axial and tangential velocity components (a spiral path). Orienting the bleed passage inlet 56 as described thus maximizes the velocity and thus the available stagnation pressure of the bleed fluid entering the bleed passage inlet 56. Angles $\alpha$ and $\beta$ will generally depend upon the design of the particular compressor (rotational speed, mass flow rate, etc.) as well as the fluid type.

As further embodied herein, bleed passage outlet 58 is configured to maximize the strength of the reflected expansion waves. With reference to FIGS. 3 and 4, bleed passage outlets 58 are formed as sharp edged ports in the wall 52 of housing 18, although other configurations are possible. The abrupt expansion of a compression wave into collector 54 will produce the desired reflected expansion wave travelling countercurrent to the bleed passage fluid flow, as will be appreciated from acoustic considerations.

As still further embodied herein, the number and average cross-sectional flow area of the individual bleed passages 50 will depend upon several factors, including the fluid type, the speed and flow rate of the compressor, as well as the actual configuration of the compressor housing 18, hub 12, blades 14, etc.

For a typical inducer, bleeding off some 25–50% of the boundary layer affected flow will in most cases improve boundary layer shape factor and thereby reduce rotor separation losses. The size of the bleed channel consequently will depend on the flow quality at the point of extraction. For a high pressure bleed, factors external to the compressor (bleed flow requirements for cooling, etc.) may dictate a bleed flow rate in excess of what is strictly needed from compressor performance point of view. In most cases a number of bleed channels of about 5 to 10 times the number of rotor blades will be adequate.

Further in accordance with the present invention, as embodied herein, the bleed passages 50 are formed at the juncture of housing shroud sections 32, 34 which have respective abutting, mating surfaces 60, 62 which are depicted in FIG. 2 as slightly separated only for ease of visualization. Mating surfaces are formed at the angle $\alpha$ to a radius in the axial direction of compressor 10 and individual channels are cut in one of the surfaces, such as surface 62 in FIG. 3 at the angle $\beta$ in the tangential direction to a radius. The other mating surface, surface 60 in FIG. 2, when tightly and sealingly abutted to surface 62, forms the bleed passages 50 with the desired angular orientation $\alpha$, $\beta$. This fabrication technique allows the variable cross-sectional area of bleed passages 50 to be easily formed and maintained within desired dimensional tolerances.

Figure 5:
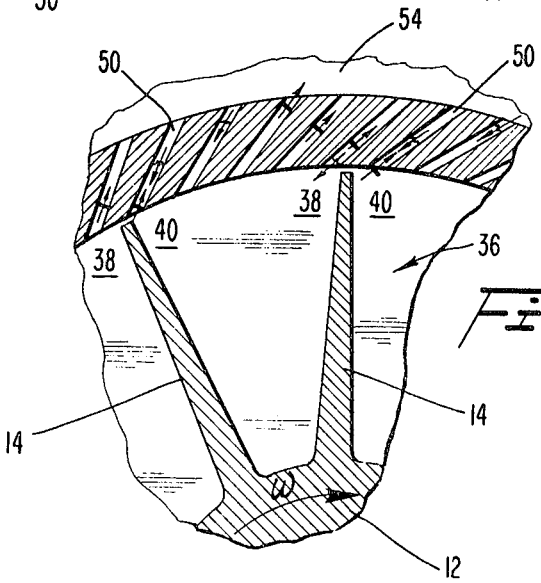
FIG. 5 is a further view of the apparatus shown in FIG. 3.

In operation, and further in accordance with the present invention, the improved method of extracting the boundary layer from rotary compressors in the region of the compressor housing wall includes the step of periodically lowering the static pressure at the bleed passage inlet to coincide with the arrival of the suction sides of the compressor blades, for increasing the amount of fluid extracted from the suction sides for a given collector static pressure. As embodied herein, the periodic static pressure lowering step further includes the step of periodically generating compression waves in bleed passages 50 using the fluid extracted from pressure sides 40 of the compressor blades 14, as was discussed previously. As is depicted in FIG. 5, shock-type compression waves (designated by solid bars with arrows) are shown being generated in successive bleed passages 50 by each of blades 14 (only two are shown). These travel through the bleed passages 50 toward the collector 54 at essentially the same speed (speed of sound in the fluid), but the position of the individual waves in the respective bleed passages 50 is staggered due to the difference in time of generation.

In accordance with the present invention, as embodied herein the pressure lowering step next includes the step of reflecting the compression waves at the bleed passage outlets 58 to form expansion waves (designated in FIG. 5 by wavy lines with arrows) travelling back through bleed passage 50 toward the bleed passage inlets 56. In FIG. 5, the expansion waves are shown "passing" the subsequently formed compression shock waves because, due to the superposition principle in acoustic waves, the static pressure at a given location can be computed as the sum of the influences of the separate waves.

In accordance with the present invention and as embodied herein, the pressure lowering step includes the step of admitting the expansion waves to the housing region 36 through the passage inlet 56 after the passage of the compressor blades 14, that is, in the vicinity of the suction side region 38. The coincidence of arrival of the suction side region 38 and the arrival of the expansion waves at the bleed passage inlet 56 is provided by the preliminary step of acoustically sizing the length of bleed passages 50 so that the period of the expansion waves is equal to, or a multiple of, the time between the passage of successive ones of blades 14.

As embodied herein, the improved extraction step of the present invention also includes the step of receiving into the bleed passages 50 the bleed fluid at high velocity by orienting the bleed passage inlet 56 as described earlier, and the step of diffusing the high velocity fluid to increase the static pressure in the bleed passage 50, such as by providing a continuously increasing cross-sectional flow area for bleed passage 50, as described previously.

It will be apparent to those skilled in the art that various modifications and variations could be made in the improved compressor boundary layer bleeding system of the present invention, without departing from the scope or spirit of the invention.

What is claimed is:

1. Improved method for controlling the fluid boundary layer in a compressor having a plurality of blades rotating in a housing, the method including the step of continuously extracting fluid from the region of the housing wall through at least one bleed passage formed in the housing wall to a fluid collector, the bleed passage having an inlet and an outlet, the improvement in the extracting step comprising the step of periodically lowering the static pressure at the bleed passage inlet to coincide with the arrival of the suction sides of the compressor blades, for increasing the amount of fluid extracted from the suction sides for a given collector static pressure.

2. Improved method as in claim 1 wherein said pressure-lowering step includes the substeps of:

(a) periodically forming expansion waves in the bleed passage, said expansion waves travelling in the direction opposite the flow of fluid being extracted; and (b) admitting in succession each of said expansion waves to said region through the bleed passage inlet immediately after a blade has passed the bleed passage inlet.

3. Improved method as in claim 2 wherein the substep of forming an expansion wave includes the additional substeps of (i) periodically forming compression waves in the bleed passage with the fluid extracted from the pressure sides of successive blades, and (ii) reflecting said compression waves at the bleed passage outlet to produce said periodic expansion waves.

4. Improved method as in claim 2 wherein the period of said expansion waves is equal to, or a multiple of, the time between the passage of successive blades past the bleed passage inlet.

5. Improved method as in claim 2 or 3 wherein the substep of periodically forming expansion waves is carried out at a location in the bleed passage spaced from the bleed passage inlet, and wherein the substep of admitting the expansion waves includes the substep of transmitting the expansion wave a predetermined distance through the bleed passage to the bleed passage inlet to provide said coincidence.

6. Improved method as in claim 1 wherein the extracting step further includes the step of receiving the extracted fluid into the bleed passage at maximum fluid particle velocity and the step of diffusing the fluid in the bleed passage to maximize the bleed passage pressure relative to the available compressor housing region stagnation pressure.

7. Improved apparatus for controlling the fluid boundary layer in a compressor having a plurality of blades rotating in a housing, the apparatus having at least one bleed passage through the housing wall connected to a fluid collector for continuously extracting fluid from the region of the housing wall, the bleed passage having an inlet and an outlet, the improvement comprising:

means for periodically lowering the static pressure at the bleed passage inlet to coincide with the arrival of the suction sides of successive blades for increasing the amount of fluid extracted from the suction sides for a given collector static pressure, wherein said pressure lowering means includes means for periodically generating expansion waves in the bleed passage, said expansion waves travelling in the direction opposite that of the flow of fluid being extracted and means for timing the arrival in succession of each of said expansion waves at the bleed passage inlet to occur immediately after a blade has passed the passage inlet.

8. Improved aparatus as in claim 7 wherein said generating means includes said bleed passage inlet being located in the portion of the housing wall adjacent the rotating blades and oriented for receiving successive compression waves formed in the fluid extracted from the pressure sides of the rotating blades and travelling in the bleed passage toward the collector, and said bleed passage outlet being configured to provide an abrupt flow area expansion into the collector to reflect the successive compression waves as expansion waves travelling back towards the compressor blades.

9. Improved apparatus as in claim 8 wherein said timing means includes the length of said bleed passage being acoustically sized to provide coincidence between the periodic arrival of the suction sides of the compressor blades and the periodic arrival of said expansion waves at the bleed passage inlet.

10. Improved apparatus as in claim 9 wherein the length of each of said acoustically sized bleed passage is such that the period of time between successive expansion waves in a given bleed passage is equal to, or a multiple of, the time between the passage of successive blades past the bleed passage inlet.

11. Improved apparatus as in claim 9 wherein the length of said acoustically sized bleed passage is about $L_a$, where $L_a$ is defined as follows:

$$L_a = (a) \cdot \frac{30}{Z_r N} \cdot \frac{Z_b + Z_r}{Z_b}$$

where (a)=velocity of sound in the fluid, $Z_r$=number of blades $Z_b$=number of bleed passages, and N=rotational speed (RPM).

12. Improved apparatus as in claim 11 wherein the length L of said bleed passages is $L_a$ plus an integer multiple of $[+a/NZr]$, where (a)=velocity of sound in the fluid, N=rotational speed (RPM), and $Z_r$=number of blades.

13. Improved apparatus as in claim 8 wherein the compressor housing includes a two part shroud having abutting surfaces and wherein a continuous channel is formed in one of said abutting shroud surfaces, the other of said abutting shroud surfaces enclosing said channel to form said bleed passage.

14. Improved apparatus as in claim 13 wherein said two part shroud also forms the fluid collector.

15. Improved apparatus as in claim 9 wherein the bleed passage inlet is inclined to a radius drawn to the axis of rotation of the compressor blades both in the direction of rotation and in the direction of the rotational axis.

16. Improved apparatus as in claim 9 wherein the cross-sectional flow area of the bleed passage increases in the bleed fluid flow direction for diffusing the bleed fluid flowing therein.

17. Improved apparatus as in claim 9 wherein a plurality of bleed passages are positioned in the housing and evenly distributed in the tangential direction, and wherein the number of bleed passages is greater than the number of compressor blades.

18. Improved apparatus in claim 17 wherein the number of bleed passages is about five to ten times the number of compressor blades.

* * * * *

UNITED STATES PATENT AND TRADEMARK OFFICE

CERTIFICATE OF CORRECTION

PATENT NO. : 4,479,755
DATED : October 30, 1984
INVENTOR(S) : Ivar H. Skoe

It is certified that error appears in the above—identified patent and that said Letters Patent is hereby corrected as shown below:

Claim 12, Line 3, change "[+a/NZr]" to

--[30a/NZr]--

Signed and Sealed this

Second Day of April 1985

[SEAL]

*Attest:*

DONALD J. QUIGG

*Attesting Officer*

*Acting Commissioner of Patents and Trademarks*